US005815083A

United States Patent [19]

Patarin et al.

[11] Patent Number: 5,815,083

[45] Date of Patent: Sep. 29, 1998

[54] PROCESS FOR ENTRY OF A CONFIDENTIAL PIECE OF INFORMATION AND ASSOCIATED TERMINAL

[75] Inventors: Jacques Patarin, Viroflay; Michel Ugon, Maurepas, both of France

[73] Assignee: Bull CP8, Louveiennes, France

[21] Appl. No.: 387,817

[22] PCT Filed: Jul. 1, 1994

[86] PCT No.: PCT/FR94/00809

§ 371 Date: Apr. 14, 1995

§ 102(e) Date: Apr. 14, 1995

[87] PCT Pub. No.: WO95/01616

PCT Pub. Date: Jan. 12, 1995

[30] Foreign Application Priority Data

Jul. 1, 1993 [FR] France ..... 93 08073

[51] Int. Cl.[6] ..... G07F 7/02

[52] U.S. Cl. ..... 340/825.31; 340/543; 340/825.34; 361/172; 341/23; 341/28; 345/50; 345/116; 345/178

[58] Field of Search ..... 340/825.3, 825.31, 340/825.56, 543, 825.34; 361/171, 172; 341/22, 23, 20, 28; 345/1, 3, 50, 116, 141, 168, 178

[56] References Cited

U.S. PATENT DOCUMENTS

| | | | |
|---|---|---|---|
| 4,122,444 | 10/1978 | Kitajima et al. | 345/50 X |
| 4,333,090 | 6/1982 | Hisrsch . | |
| 4,502,048 | 2/1985 | Rehm | 341/22 X |
| 4,727,357 | 2/1988 | Curtin et al. | 341/22 |
| 4,857,914 | 8/1989 | Thrower | 340/825.31 |
| 5,128,672 | 7/1992 | Kaehler | 341/23 |
| 5,274,370 | 12/1993 | Morgan et al. | 340/825.56 |
| 5,276,314 | 1/1994 | Martino et al. | 340/825.31 X |
| 5,396,226 | 3/1995 | Wake et al. | 340/825.31 |

FOREIGN PATENT DOCUMENTS

| | | | |
|---|---|---|---|
| 2459514 | 1/1981 | France . | |
| 4129202 | 3/1993 | Germany . | |
| 2153568 | 8/1985 | United Kingdom . | |
| 8102349 | 8/1981 | WIPO . | |
| 92/06464 | 4/1992 | WIPO | 345/50 |
| 9311551 | 6/1993 | WIPO . | |

*Primary Examiner*—Brian Zimmerman
*Assistant Examiner*—William H. Wilson, Jr.
*Attorney, Agent, or Firm*—Kerkam, Stowell, Kondracki & Clarke,P.C.; Edward J. Kondracki

[57] ABSTRACT

With confidential information being composed of authenticating signs which belong to a first series, a second series of signs or designating symbols is defined, the first and second series of signs are displayed in a relatively random position, and this placement in correspondence is used to enter the confidential information in such a way that a third party who observes the entry operations cannot determine the confidential information. The invention also relates to the terminal associated with this process.

15 Claims, 2 Drawing Sheets

PROCESS FOR ENTRY OF A CONFIDENTIAL PIECE OF INFORMATION AND ASSOCIATED TERMINAL

BRIEF SUMMARY OF THE INVENTION

Field of the Invention

The present invention relates to a process for entry of a confidential piece of information furnished by a user at a terminal, this information comprising several signs which belong to a first series of signs referred to herein also as authenticating signs.

BACKGROUND OF THE INVENTION

It is known that means for electronic payment using a card associated with a terminal are becoming widespread, and that these include ticket dispensers and in-store means of payment.

In order to identify a card holder or an operator, this person is often required to input a confidential piece of information, usually called a code, by means of a keyboard associated with the terminal. The conditions under which this code must be input by means of the keyboard do not generally permit the keyboard to be satisfactorily hidden, so that it can be observed by a third party during the entry of the confidential information. An ill-intentioned person can then use this information to fraudulent ends.

Certain systems include keyboards whose signs are disposed in positions that vary from one keyboard to another so that it is not possible for a third party who does not know the disposition of the signs on a keyboard in the course of being used to guess the confidential information simply by observing the position of the keys the user strikes. This, however, has the drawbacks of substantially complicating the embodiment of the keyboard and of engendering errors in the inputting of the confidential information when users who are used to a certain disposition of the signs do not pay attention to the fact that the keyboard in question does not have the usual disposition. In addition, an experienced defrauder can analyze the redistribution of the signs on a specific keyboard either before or after the entry of the confidential information by the user and memorize the position of the keys struck in order to eventually deduce the confidential information.

OBJECTS AND FEATURES OF THE INVENTION

One object of the present invention is to propose a process for protecting a confidential piece of information comprising several confidential signs which belong to a first series of authenticating signs during the entry of this information, even when this operation may be observed by a third party.

With a view to the achievement of this object, the process according to the invention consists of defining a second series of signs or designating symbols; of displaying the first and second series of signs on a display means so that each authenticating sign in the first series will be disposed opposite a sign or designating symbol in the second, and of using the signs in the second series of signs, opposite which the signs in the first series composing the confidential information are disposed, for the user's designation of the confidential information.

Thus, the user does not directly designate the signs which compose the confidential information, but rather the signs—those in the second series—which are correlated with these signs in accordance with a correlation site that does not appear explicitly on the display means. Consequently, merely observation of the display means by a third party does not permit him or her to deduce the confidential signs that are entered.

In a first variant of the process according to the invention, one makes use of a keyboard which is distinct from the display means and which comprises a plurality of keys, identifies each of the keys on the keyboard by assigning it a sign or designating symbol that belongs to the second series of signs, and displays the first and second series of signs on the display means in a random mutual distribution that is known to the terminal; the user designates the authenticating signs in the first series which compose the confidential information by depressing each key on the keyboard whose sign or designating symbol corresponds to the sign or designating symbol in the second series that is located opposite one of the authenticating signs belonging to the first series which constitute the confidential information.

Thus, when a user enters a confidential piece of information, the keys on the keyboard that he or she strikes do not include the authenticating signs of his or her code, but corresponding signs or designating symbol in accordance with a correspondence that is given to the user by means of simultaneous display of the two series of signs. Given that this correspondence varies with each entry of the confidential information as a function of the relative positioning of the series of signs, the only possible recognition of the keys struck on the keyboard during an entry is useless to a defrauder.

According to one advantageous version of this aspect of the invention, at least one of the series of signs disappears as soon as a key is struck. Thus, it is not possible for a defrauder to first see the key that is struck and then learn the sign that corresponds to the first series by observing the series that are displayed.

With the aid of the versions described previously, the user can henceforth enter a confidential piece of information without divulging the slightest indication to a third party, who can only see the keyboard or the screen.

According to a second variant of the process according to the invention, a solution is brought to bear on the problem of a third party who can observe the screen and the keyboard at the same time; in order to do this, at least one reference sign known to the terminal and to the user is secretly defined from among the signs or designating symbols in the second series, and then the authenticating signs in the first series of signs are displayed opposite the signs in the second series in such a way that each time, one of the signs which compose this confidential information is disposed opposite the reference sign.

In an advantageous version of this aspect of the invention, during the entire entry operation, the set of authenticating signs in the first series is displayed in arbitrary order; the set of signs is shifted in relation to the signs or designating symbols in the second series so that at least one confidential sign composing the confidential information is disposed in front of the reference sign; and the entry is validated when the user gives the terminal a validation order indicated that this confidential sign has been place in front of the reference sign.

According to yet another version of the invention in which the terminal includes a keyboard with a plurality of keys, each of the keys on the keyboard is identified by being assigned a sign that belongs to the first series of signs, and for each key that is depressed, the authenticating sign in the first series assigned to this key is displayed opposite a sign or designating symbol in the second series; the terminal is arranged in order to effect a comparison between the sign in the first series that has thus been placed by the user in front of the reference sign and at least one of the signs of the confidential information.

The invention also relates to a terminal including a display means and means for entering a confidential piece of information furnished by a user, this information comprising several authenticating signs belonging to a first series of signs; the terminal is arranged in order to display the first and a second series of signs on the display means so that each sign in the first series will be disposed opposite a sign or designating symbol in the second series, and it comprises, on one hand, means for using the signs in the second series located opposite the signs that constitute the confidential information to allow the user to designate the signs in the first series that compose the confidential information, and on the other hand, means for validating the entries.

BRIEF DESCRIPTION OF THE DRAWINGS

Other characteristics and advantages of the invention will become apparent upon a reading of the following description of different versions of the invention in connection with the appended figures, in which.

DESCRIPTION OF THE PREFERRED EMBODIMENTS

Figure 1:
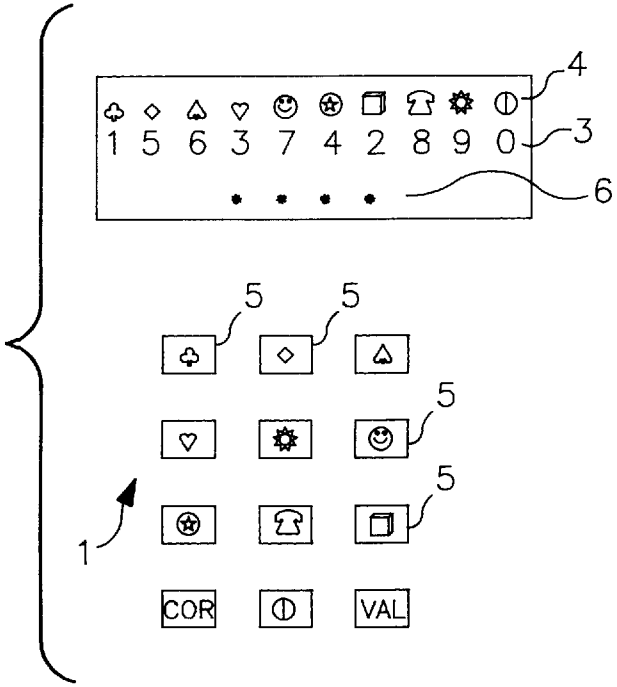
FIG. 1 schematically illustrates part of a terminal using a first variant of the process according to the invention.

In reference to FIG. 1, a first variant of implementation of the process according to the invention is intended to make it possible to protect a confidential piece of information, for example the code of a bank card, during its entry on the keyboard of a terminal. FIG. 1 represents only the keyboard of the terminal shown in fragmentary portion by a solid line T. The key board is designated generally as 1, and the display screen of the terminal, is designated generally as 2. In a manner known per se, the confidential information is composed of authenticating signs which belong to a series of signs, for example digits in the example illustrated. Following the description, it will be assumed that the confidential information is composed of four signs and that in the examples illustrated, these four signs are the digits 4723.

According to this variant of the invention, a second series of signs or designating symbols is represented on the keys 5 of the keyboard 1 of the terminal, and on one hand a first series of signs, disposed here in a line 3 on the display screen, and on the other hand the second series of signs, disposed here in a line 4 on the display screen above the first series of signs in the line 3, are displayed on the terminal; the first and second series of signs are displayed according to a random relative position, which means that the correspondence between the authenticating signs in the first series and the signs or designating symbols in the second series can vary each time a card is inserted into the terminal. Thus, the keys on the keyboard which must be struck vary with each new display of the two series of signs so that a third party who observes only the keys struck by the user will not be able to reuse the information thus obtained during a subsequent entry.

According to a first version of the invention, it is assumed that the first and second series of signs continue to be displayed in the same relative position while the user enters the different signs on the keyboard. In the case envisioned, the user will then successively strike the keys on the keyboard comprising θ, then ☺, then □, and finally ♥. The symbol θ corresponds to the star symbol in the drawings comprising a white star on a black circular background. The symbol θ is used throughout the text because of the lack of a proper font corresponding to the star symbol used in the drawings, but it will be understood that θ represents the same function as the white star on a black circular background. In order to facilitate the user's entry of the confidential information, the display screen 2 usually and preferably comprises a line 6 of marks which indicate the number of signs already entered, thus allowing the user to know what position in the confidential information he has reached. In the example illustrated, the signs in the line 6 begin as dots, and are progressively replaced with asterisks each time the user enters a sign.

It will be noted that in this version of the process of the invention a defrauder who observes only the keyboard will not in any way understand the confidential information since he does not know the correspondence between the signs struck on the keyboard and the digits which compose the code. If, however, he is also capable of seeing the screen, he will be able to memorize the correspondence between the two series of signs, or more simply, to look at this correspondence each time he sees the user strike one of the keys on the keyboard. In fact, reading the correspondence involves a relatively sustained effort on the part of the user who tends to verify that he is not making a mistake with the signs or designating symbols in the second series and therefore proceeds more slowly than usual. In this case, it will therefore be possible for a defrauder who has seen the user strike the key θ to then look at the screen and discover that θ corresponds to the digit 4, and thus to successively execute a decoding of the signs struck by the user.

Figure 2:
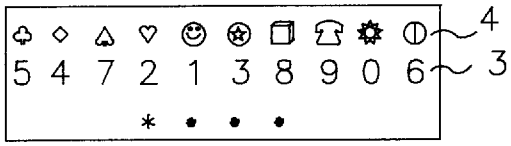
FIG. 2 is a schematic representation of the display screen at a later stage than in FIG. 1, relating to a variant of implementation of the process according to the invention.

In order to avoid such a maneuver on the part of the defrauder, another version of the invention envisions preferably changing the relative position of the first and the second series of signs after each authenticating sign of the confidential information is entered. Thus, even when a third party is capable of observing not only the keyboard but also the display of the series of signs, the considerable frequency of change in the correspondence between the authenticating signs in the first series and the designating symbols in the second series increases the difficulty of memorizing this correspondence simultaneously with the position of the key struck by the user. FIG. 2 illustrates the display which the user sees on the screen as soon as he strikes the key 6. According to the version illustrated, the second series of signs is left in the same position but the first series of signs is displayed in a new disposition of the digits, while in the line of marks 6 the first dot has been replaced by a asterisk. According to this version of the invention, after having begun as before by striking the key θ, this time the user will strike the key ♠ which corresponds to the second digit of his or her code, in this case 7. It will be noted, therefore, that it is not possible for a defrauder who has waited to see the key struck by the user to determine the corresponding sign in the first series. In fact, the defrauder who has waited and has seen the user strike the key 0 and who then looks at the display screen will read that the digit corresponding to θ is the digit 3 and will thus make an error in guessing the first digit of the confidential information. In order to be able to obtain the confidential information, the defrauder would therefore have to be able to successively memorize the correspondences between the first and the second series of signs before the user has struck a sign, which considerably reduces the risk that a defrauder would be able to memorize the set of authenticating signs of the confidential information.

In the example illustrated in FIGS. 1 and 2, the two series of signs are displayed on the screen, but only the authenticating signs in the first series have a variable position. It will be noted that it is of course also possible to vary the position of the signs or designating symbols in the second series, or even to vary the position of the signs in the second series while holding the signs in the first series in a fixed position.

Figure 3:
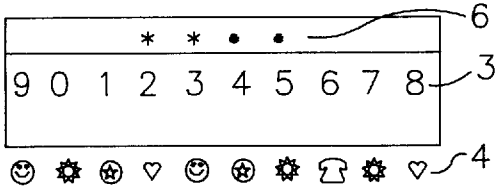
FIG. 3 is a schematic illustration of the screen of a terminal relating to another version of the process according to the invention.
Figure 4:
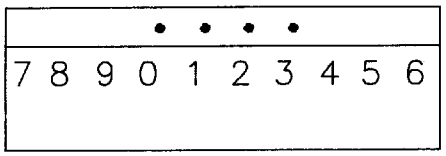
FIG. 4 is a later illustration of the screen of the terminal than in FIG. 3, which relates to the version of the process in FIG. 3.
Figure 5:
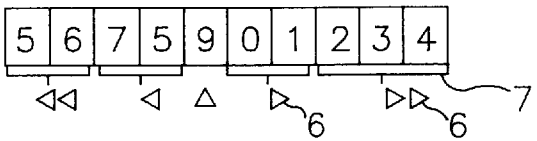
FIG. 5 is another illustration of the process according to FIG. 3, comprising a second series of signs or designating symbols which are constituted by arrows, and FIG. 6 schematically illustrates part of a terminal using a second variant of the process according to the invention.

FIGS. 3 through 5 illustrate another version of the process according to the invention. In this version, the signs or designating symbols in the second series are now disposed below the authenticating signs in the first series, and they are permanently disposed on the housing of the terminal below the display screen. This disposition does not characterize this version of the process of the invention, and it would be possible to adopt the same disposition for the signs as in FIGS. 1 and 2. What does characterize this version of the process of the invention is the fact that the second series of signs now comprises a distinct number of distinct signs that is lower than in the first series of signs, so that in order to have a correspondence between each of the authenticating signs in the first series and the signs or designating symbols in the second series, it is necessary to assign the same sign in the second series to several signs in the first series. In the example illustrated in FIGS. 3 and 4, the first series of signs comprises, as before, ten digits from zero to 9,and the second series of signs now comprises only five distinct signs which are ☺, θ, ☼, ♥, ☎. In order for a sign in the second series to correspond to each sign in the first series, certain signs in the second series are represented with a brace in order to show the signs in the first series to which they are assigned. Thus the ☺ is assigned to two digits as are the θ and the ♥, while the ☼ is assigned to three digits and the ☎ is assigned to a single digit.

When a card is inserted, the authenticating signs in the first series are displayed randomly so that one sign or designating symbol in the second series corresponds to each sign in the first series. In this regard, it will be noted that the position of the signs in the first series can be totally random, which means that the signs in the first series are disposed randomly not only relative to the signs in the second series but also relative to one another, or in a pseudo-random fashion, which means that while being disposed randomly relative to the signs in the second series, the digits in the first series are disposed in sequence relative to one another. This is the case in the example illustrated in FIG. 3, in which the digits are arranged relative to one another in a loop sequence, and their random position relative to the signs in the second series is determined by a random shift in the sequence. In FIG. 3 in particular, the zero corresponds to the second box, with a ☼, in the second series.

Assuming that the position of the signs in the first series remains constant during the entire entry of the confidential information, a user who has the code 4723 will then enter, in the case of FIG. 3, the signs θ, ☼, ♥ and ☺ successively. Contrary to the version which has been described in relation to FIG. 1, a defrauder who simultaneously observes the keyboard and the screen will not be able to deduce the confidential information entered by the user with certainty. In effect, when a defrauder sees the user enter the first sign θ, he can not know if this sign corresponds to digit 1 or to digit 4. Likewise, when the user enters the sign ☼, an observer cannot know if this ☼ corresponds to the digit 0, the digit 5, or to the digit 7. In the same way, the sign ♥ may correspond to either the digit 0 or the digit 8. Only the sign ☎ corresponds solely to the digit 6. In this case the same sequence of signs in the second series would have been entered by the user whether the code were 1529 or 4089.

Assuming that an observer has succeeded in memorizing the entire correspondence between the authenticating signs in the first series and the designating symbols in the second series and the order in which the keys have been struck by the user, and assuming that he would want to reuse this information during a subsequent entry, he will find himself confronted with a new table of correspondence as illustrated, for example, in FIG. 4. In this figure, a new shift has been executed between the series of digits forming the first series of signs and the second series of signs. It so happens that the choice between the 1 and the 4 which could have been noted by an observer during the preceding entry, is now illustrated by a ☺ and a ☎, which means that there is one chance in two that the defrauder will make a mistake in the entry of the first sign constituting the confidential information. Likewise, a defrauder will again have a doubt concerning the second sign to be entered, since the digits 0, 5 and 7 which corresponded to the sign ☼ in FIG. 3 are represented in FIG. 4 by the signs ♥, ☼ or ☺. Note that the probability of an observer's being able to reenter the confidential information exactly is extremely low. This risk is further minimized if, as previously, it has been envisioned that the correspondence between the first series of signs and the second series of signs will change each time a sign has been entered.

The variant in FIG. 5 is distinguished from that in FIG. 3 in that the sophisticated icons constituted by the signs or designating symbols in the second series have been replaced here by simpler signs which are made of a single elementary sign, namely an isosceles triangle. The second series of signs or designating symbols comprises five signs, each of which is distinguished by a specific number of triangles or by a specific orientation of them. Thus, all three of the digits 2 through 4 in the first series of signs are designated by the same sign, which in FIG. 5 is constituted by two juxtaposed triangles 6 oriented toward the right. A brace 7 defines this correspondence. The digits 0 and 1 are designated by a single triangle 6 with the same orientation as for the digits 2 through 4. A second series of this type, made of a single simple sign, is advantageous in that the use immediately memorizes the set of signs used. In addition, the digits in the first series of signs (for example 2 through 4) that are designated by the same sign in the second series are juxtaposed, so that a single sign (here the two triangles 6) designates them both simultaneously, which further facilitates the user's task.

Figure 6:
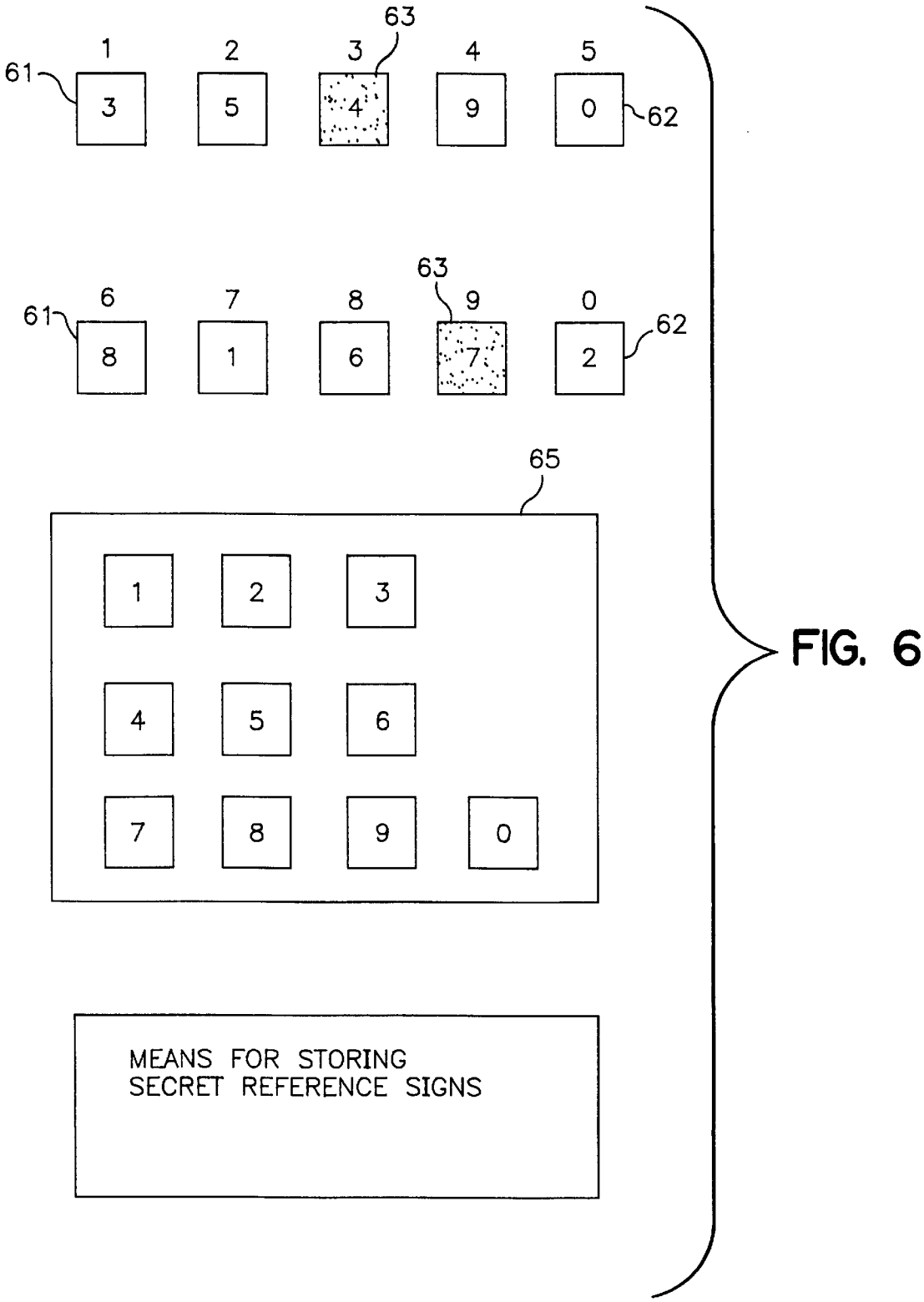

FIG. 6 illustrates another variant of implementation of the process in which it is assumed that, in addition to the digits 4723, the user's confidential code includes two secret reference signs 3 and 9 among the signs or designating symbols in the second series, and that all these signs are known to the user and to the terminal at the time of the entry. These reference signs can, for example, be provided to the user by the authorizing institution, along with the confidential information, when subscription to the service is requested and can be provided to the terminal by storing them in storing means 64.

In this FIG. 6 the two series are identical, and the signs which compose them here are the digits 0 through 9. The terminal displays the second series of signs 61, either in a permanent fashion, with the signs etched into the display means, or in a random fashion. The display boxes have been arranged so as to display the authenticating signs in the first series, which are to be entered, opposite the signs or designating symbols in the second series. In the example of FIG. 6, the boxes 63 which correspond to the boxes placed opposite the reference signs 3 and 9 have been grayed in. Of course, since the display on the screen is non-specialized, there is no indication which might allow a defrauder to determine which of the displayed signs are the reference signs.

The keyboard 65 associated with these display means comprises keys identified by the signs 0 through 9 and it permits the user to enter these signs, which are then displayed in the boxes located opposite the signs in the second series as soon as the entries are made. The user will then enter unimportant signs into all the boxes other than these two, which here are referred to as 63. Conversely, he or she enters the first two digits, 4 and 7, of his or her confidential information into these boxes 63. This entry is complete when all the boxes are filled; the terminal then directs the user to again enter a series of signs opposite the series comprising the reference signs, so as to enter in the same way the two remaining digits of his or her confidential information, 2 and 3. For a third-party observer it is possible, with added memorization effort, to remember the complete combination that has been entered, but he or she has no way to determine which of the signs has any particular importance. In the case in which the signs in the second series are displayed randomly from the start, entering this combination would avail him nothing.

A system for scrolling the authenticating signs in the first series, in a sequence that is displayed opposite the second series, may also be envisioned. For this purpose, means for shifting these signs have been provided. For example, two shift keys, respectively on the left and on the right, or even a single key, may be used to initiate cyclical scrolling of the authenticating signs in the first series.

Each time one of these keys is pressed, or after a given, very brief time lapse, the sequence is then shifted by one position in the chosen direction, and this is done cyclically so that there will always be an authenticating sign in the first series placed opposite a sign or designating symbol in the second. When the first sign of the confidential information is located opposite one of the reference signs, the user gives a validation order, for example using a validation key or a vocal command.

The signs of at least one of the two series are then displayed in a new random sequence before the entry of the next sign of the confidential information. Generally this is enough to indicate to the user that the preceding sign has been effectively captured by the system and that the system is waiting for the next entry.

The cycle repeats itself until all the confidential information has been entered. At the end of the operation, it is possible to simply display a message or erase the sequences of signs, which signals to the user that the entry has been completed. It is possible to envision the display of a character, for example the sign *, for each sign entered.

In the case presented in FIG. 6, the signs of the confidential information are entered in an ordered fashon, according to an arrangement (1 . . . i . . . n). In order to confuse an observer, this information can be entered in a disordered fashion. To this end, the terminal displays a message directing the user to place his or her sign(s) that are in the i position opposite his or her reference sign(s). In this way, the entry order is shuffled, and it changes with each new entry.

In the case in which the confidential information is composed of digits, as in the example in FIG. 6, the terminal's message can also direct the user to place the digit, which results from a function of those digits of his or her confidential information that are in the i and j positions, opposite the reference signs. Of course, this function is modified with each entry.

Let it be supposed for now that the message comprises:

Secret box 1: enter the third digit of your code, plus 1.

Secret box 2: enter the first digit of your code, minus 1.

The user must then enter the digits 3 (digit 2 plus 1) and 3 (digit 4 minus 1) into the boxes 63 which correspond to the reference signs. A potential defrauder who gains knowledge of the message and who retains the digits that are entered does not know to which of the entered digits he must apply these functions in order to obtain the confidential information.

It is understood that the invention is not limited to the mode of embodiment described and variant embodiments may be achieved without departing from the scope of the invention. In particular, although the authenticating signs in the first series have been illustrated by digits, any signs may be envisioned; the signs used may even be different from one card to another, and the display of the signs in the first series would then be produced by the terminal as a function of a codification contained in the card.

It is also possible to envision identical signs for the first and the second series of signs. In this case it would be necessary that the series of signs be clearly indicated on the display screen; otherwise the risk of errors in the entry may be too great.

While this invention has been described in conjunction with specific embodiments thereof, it is evident that many alternatives, modifications and variations will be apparent to those skilled in the art. Accordingly, the preferred embodiments of the invention as set forth herein, are intended to be illustrative, not limiting. Various changes may be made without departing from the spirit and scope of the invention as set forth herein and defined in the claims.

We claim:

1. Process for entry by a user of a confidential piece of information into a terminal at the terminal having a display associated therewith, this information including a plurality of confidential signs which belong to a first series of authenticating signs (3), said process comprising:

defining a second series of designating symbols (4);

displaying the first series of authenticating signs and second series of designating symbols on the display so that each sign in the first series of authenticating signs is disposed opposite a designating symbol in the second series of designating symbols; and using the designating symbols in the second series of designating symbols, opposite which the authenticating signs in the first series of authenticating signs composing said confidential information are disposed, for the user's designation of the confidential information.

2. Process according to claim 1, wherein the process makes use of a keyboard (1) which is distinct from the display and which includes a plurality of keys, and said process further comprising:

identifying each of the keys on a keyboard by assigning each key a key symbol which belongs to the second series of designating symbols (4);

displaying the first series of authenticating signs and the second series of designating symbols on the display in a mutual random distribution that is known to the terminal; and designating the authenticating signs in the first series which compose said confidential information by depressing each key on the keyboard (1) whose key symbol corresponds to the designating symbol in the second series (4) located opposite one of the authenticating signs in the first series (3) constituting said confidential information.

3. Process according to claim 2, further including causing the first series of authenticating signs (3) or the second series of designating symbols (4) to disappear as soon as a key on the keyboard (1) is struck.

4. Process according to claim 1, further comprising:

secretly defining at least one reference symbol, from among the designating symbols (4), that is known to the terminal and to the user; and displaying the authenticating signs in the first series of authenticating signs opposite the designating symbols in the second series of designating symbols so that each time, one of the authenticating signs which compose said confidential information is located opposite said reference symbol.

5. Process according to claim 4, wherein:

during the entire entry process, the authenticating signs in the first series (3) is displayed in arbitrary order;

the first series of authenticating sign (3) is shifted in relation to the designating symbols in the second series (4) so that at least one confidential sign composing said confidential information is located in front of said reference symbol; and the user gives the terminal a validation order when said confidential sign is located in front of the reference symbol.

6. Process according to claim 4, wherein the user makes use of a keyboard (1) with a plurality of keys, in which each of the keys is identified by being assigned an authenticating sign which belongs to the first series of authenticating signs (3), and wherein the display of each of the authenticating signs in the first series (3) opposite the designating symbols in the second series (4) is produced by depressing the key identified by this authenticating sign, the terminal being arranged in order to effect a comparison between the authenticating sign in the first series that has thus been placed by the user in front of the reference symbol and at least one of the confidential signs of the confidential information.

7. Process according to claim 6, wherein said confidential information includes several confidential signs arranged in a predetermined order with a particular position (i) therein (1 . . . i . . . n), and further wherein before the user displays the authenticating signs in the first series (3), the terminal gives the user a message directing the user to place the confidential sign that is in the particular position (i) opposite the reference symbol.

8. Process according to claim 7, wherein the authenticating signs in the first series (3) which compose said confidential information are digits, and the user is directed by the terminal to place the result of a function of the digit that is in the particular position (i) of said confidential information opposite the reference symbol.

9. Process according to claim 1, wherein the second series of designating symbols (4) includes a number of distinct symbols that is less than the number of authenticating signs in the first series (3).

10. Process according to claim 1, wherein the designating symbols in the second series (4) are different from the authenticating signs in the first series (3).

11. A terminal including a display and means to enter into the terminal a confidential piece of information furnished by a user, said information including a plurality of authenticating signs which belong to a first set of authenticating signs (3), said terminal being operable to display said first series of authenticating signs and a second series of designating symbols (4) in such a way that each authenticating sign in the first series (3) is disposed opposite a designating symbol in the second series (4), said terminal further comprising:

means for using the designating symbols in the second series (4) to allow the user to designate the authenticating signs in the first series (3) which constitute said confidential information.

12. Terminal according to claim 11, wherein said terminal includes a keyboard (1) which is distinct from the display, said keyboard having a plurality of keys (5), each of said keys being identified by a key symbol which belongs to said second series of designating symbols (4), and wherein upon pressing each key on said keyboard whose key symbol corresponds to the designating symbol in the second series (4) displayed opposite one of the confidential signs constituting said confidential information an entry is made of said confidential sign constituting said confidential information.

13. Terminal according to claim 11, wherein said terminal comprises:

means for storing at least one reference symbol that is known to the user and belongs to the second series of designating symbols (4); and means for enabling the user to display the authenticating signs in the first series (3) such that the confidential signs constituting the confidential information are disposed opposite said reference symbol.

14. Terminal according to claim 11, wherein the second series of designating symbols (4) includes a number of distinct symbols that is less than the number of authenticating signs in the first series (3).

15. Terminal according to claim 11, wherein the designating symbols in the second series (4) are different from the authenticating signs in the first series (3).

* * * * *